US005235849A

United States Patent [19]

Egerton

[11] Patent Number: 5,235,849

[45] Date of Patent: Aug. 17, 1993

[54] RAILROAD COUPLER MOUNT

[75] Inventor: Gary W. Egerton, Silver Spring, Md.

[73] Assignee: Pulse Electronics, Inc., Rockville, Md.

[21] Appl. No.: 772,480

[22] Filed: Oct. 7, 1991

[51] Int. Cl.[5] ..... G01L 5/28

[52] U.S. Cl. ..... 73/129

[58] Field of Search ..... 73/129, 865.9; 246/167 R, 169 R; 213/75 R-79, 98, 99, 1 R, 100 R; 248/231.4, 53, 227, 231.9, 225.31

[56] References Cited

U.S. PATENT DOCUMENTS 2,355,544 8/1944 McGowan .
4,487,060 12/1984 Pomeroy .
4,520,662 6/1985 Schmid .
4,592,217 6/1986 Fernandez et al. .
4,691,563 9/1987 Martin .
4,747,302 5/1988 Goss ..... 73/129
4,876,885 10/1989 Martin et al. .
5,131,269 7/1992 Blosnick et al. ..... 248/53

*Primary Examiner*—Robert Raevis
*Attorney, Agent, or Firm*—Whitham & Marhoefer

[57] ABSTRACT

A railroad coupler mount includes a hook (20) for contacting the inside upper lip (28) of a coupler head (10) within a single coring hole (12*a*), a jaw member (22) which engages the rib (18) between a pair of coring holes (12*a* and 14*a*), a pad (24) for abutting against an outside surface (26) of the coupler head (10), and a handle (30) for orienting the hook (20) in the transverse or upright positions. In a preferred configuration, end-of-train signalling and monitoring equipment (42) is connected to a railroad coupler mount (44) and the handle (64) which tightens the hook (58) against the inside lip of the coupler head also serves the function of locking a battery compartment door (54) closed.

6 Claims, 6 Drawing Sheets

RAILROAD COUPLER MOUNT

BACKGROUND OF THE INVENTION

1. Field of the Invention

The present invention is generally related to railroad coupler mounts which secure equipment, such as end-of-train marker light and telemetry equipment, to the coupler head of the last car in a train and, more particularly, to railroad coupler mounts which secure equipment to the guard arm side of a coupler head.

2. Description of the Prior Art

End-of-train signalling and monitoring equipment is commonly used to meet modern railroad operating and safety requirements. Various train operating parameters (e.g., brake line pressure, and the like) are remotely monitored by the end-of-train equipment and telemetered to an engineer in the locomotive cab. In addition, the end-of-train equipment can include a marker light to identify the end of the train.

Over the years, several railroad coupler mount configurations have been devised for securing the end-of-train signalling and monitoring equipment to the coupler head of the last car in a train. U.S. Pat. Nos. 2,355,544 to McGowan and 4,487,060 to Pomeroy show signalling and monitoring equipment positioned inside the coupler head. Positioning the equipment within the coupler head is not ideal since it can be damaged by accidental mating with the coupler of another car, a situation which is likely in an active yard. Moreover, pusher locomotives cannot be connected without first removing the equipment. U.S. Pat. No. 4,592,217 to Fernandez et al. shows mounting the equipment on top of the coupler head by using a flag hole. This arrangement avoids accidental equipment damage; however, the arrangement has the disadvantage that not all coupler heads include a flag hole.

Most railroad couplers used in the United States and Canada are cast with four relief holes, or core holes, in the guard arm side of the coupler head. FIG. 1 shows a typical coupler head 10 used in the United States and Canada with four core holes 12*a–b* and 14*a–b* formed in the guard arm side. The core hole pairs, 12*a–b* and 14*a–b* respectively, are interconnected to provide passages underneath central region 16 and are divided from each other by a rib 18. The core holes 12*a–b* and 14*a–b* were not originally designed to serve any function on the finished coupler head 10; rather, they facilitated casting. Nevertheless, the industry has recognized that the coring holes are good locations for securing end-of-train signalling and monitoring equipment and several railroad coupler mounts have been devised which take advantage of them. For example, U.S. Pat. No. 4,520,662 to Schmid shows a coupler mount with four opposing jaw members which grip within the four coring holes 12*a–b* and 14*a–b* in the coupler head 10. The disadvantage of the Schmid device is that it is heavy and complicated and, therefore, difficult for a single person to install on the coupler head 10. U.S. Pat. No. 4,691,563 to Martin et al. and U.S. Pat. No. 4,876,885 to Martin et al. each describe railroad coupler mounts which include a banana shaped arm that extends through a core hole pair 12*a–b* or 14*a–b*, respectively. While the Martin et al. devices are easier to mount, there is still a need for alternative railroad coupler mounts which provide easy yet secure installation of the end-of-train signalling and monitoring equipment on the coupler head of the last car in the train.

SUMMARY OF THE INVENTION

It is therefore an object of the invention to provide a railroad coupler mount which can be secured to the guard arm side of a coupler head using only a single coring hole and the rib located between a pair of coring holes.

According to the invention, a railroad coupler mount includes a single hook which fits within one coring hole of a coupler head, a jaw which is designed to ride on the rib between a pair of coring holes, a pad positioned to bear against the outside surface of the coupler head, and a means to draw the hook against an inside upper lip of the coring hole. The hook can be rotated to a transverse position to allow easy insertion into and removal from the coring hole of the coupler head. In a particular embodiment, a handle used to rotate the hook between its transverse and upright positions serves the additional function of preventing unauthorized access to the battery compartment of the end-of-train signalling and monitoring equipment while it is installed on a coupler head.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
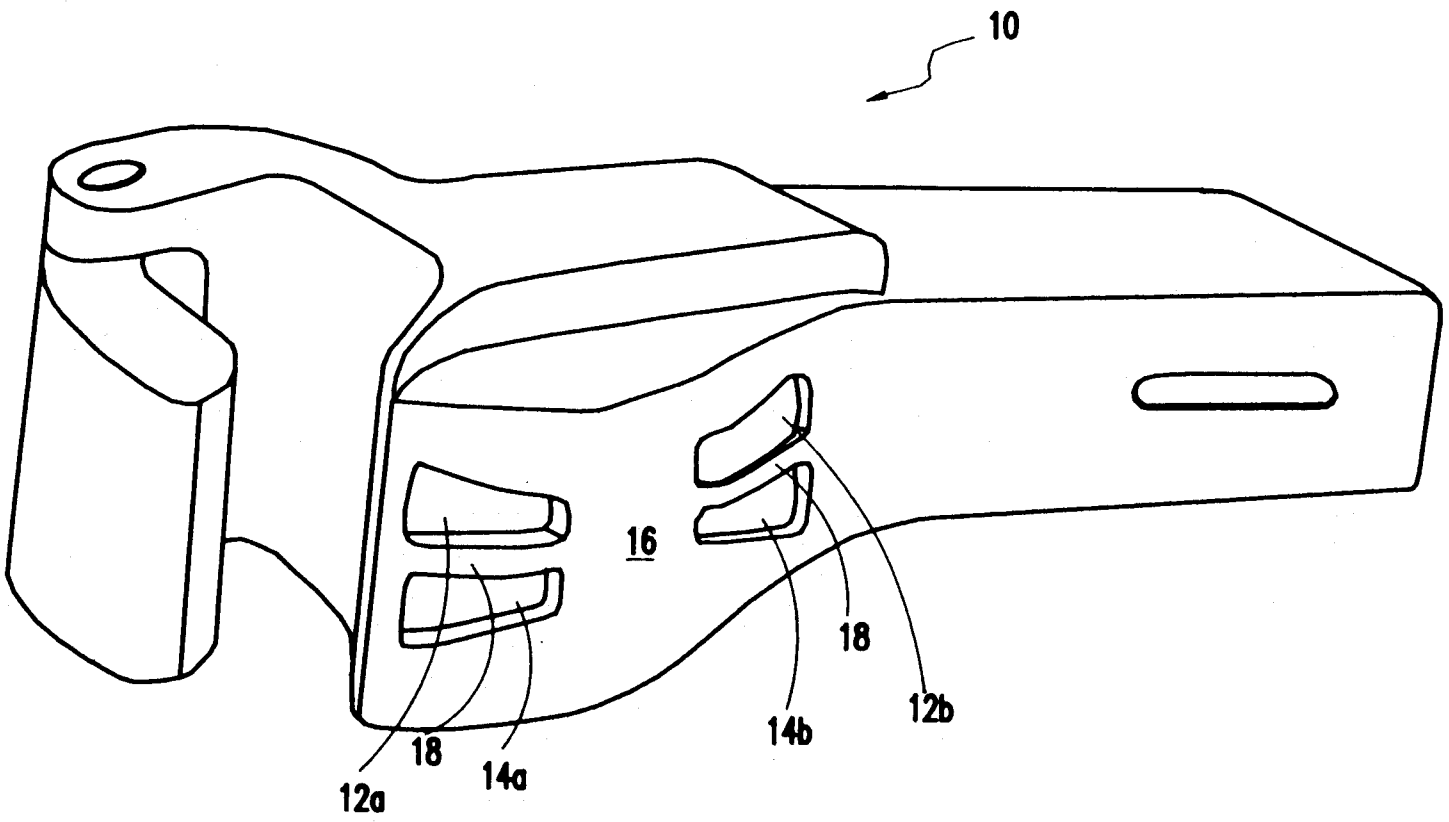
FIG. 1 PRIOR ART
FIG. 1 is an isometric view of a conventional railroad coupler head.
Figure 2:
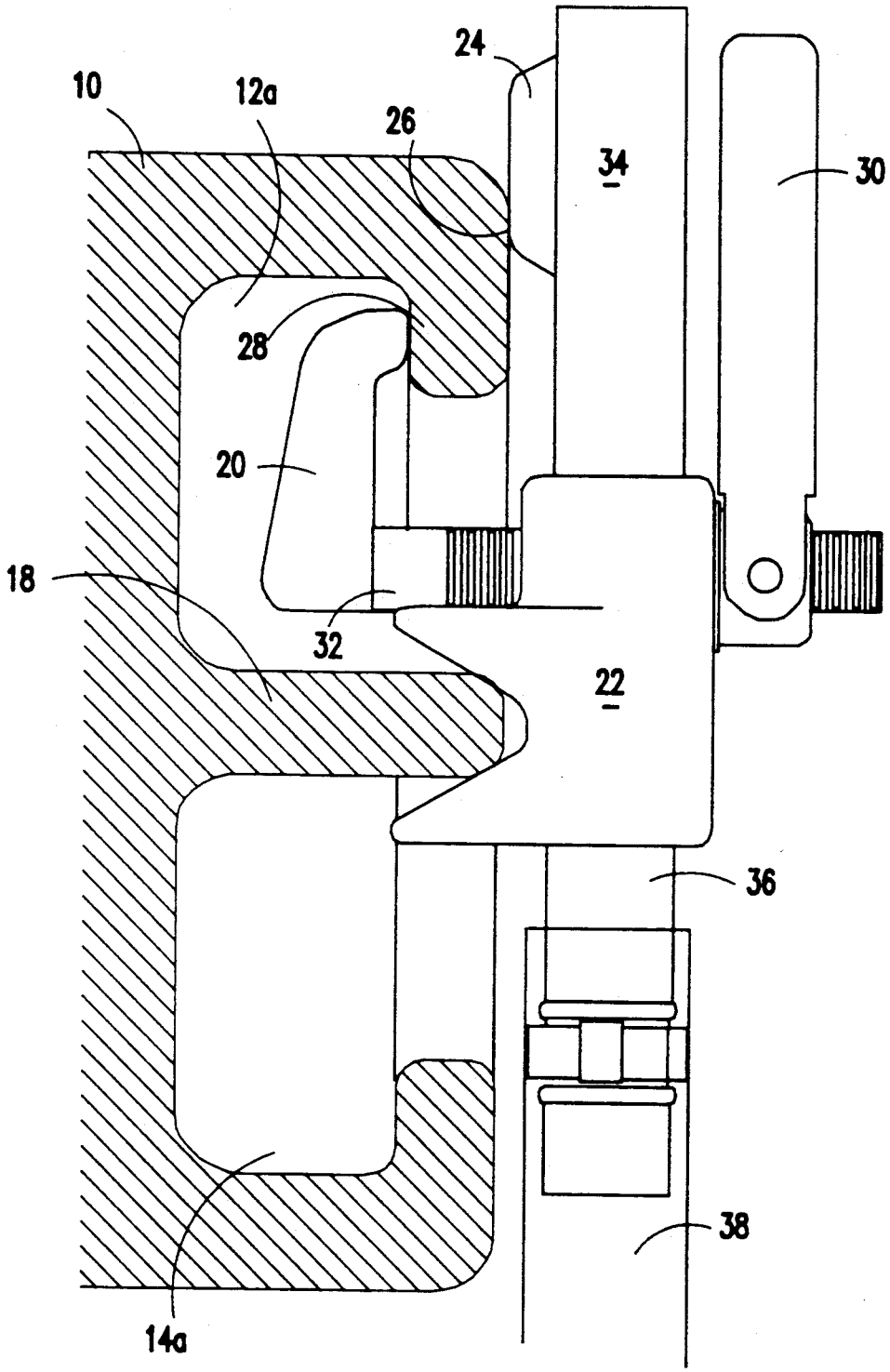
FIG. 2 is cross-sectional side view of a railroad coupler head which illustrates the means for securing the railroad coupler mount to the coupler head according to the present invention.

Referring now to the drawings, and more particularly to FIG. 2, the railroad coupler mount includes a hook 20 which fits within core hole 12*a* of the coupler head 10, a jaw 22 which is relatively wide and rides on the rib 18 that separates core holes 12*a* and 14*a*, and a pad 24 which abuts against the top side wall 26 of the coupler head 10. When the hook 20 is tightened against the inside upper lip 28 of core hole 12*a*, the pad 24 becomes tightly braced against the top side wall 26 and the jaw 22 becomes tightly engaged with the rib 18 to provide three points of contact with the coupler head 10, thereby providing a firm grip on the coupler head 10, which resists the severe shaking conditions encountered when a train rolls across several miles of track. A particular advantage of the jaw 22 riding on rib 18 and gripping against both the top and bottom surfaces of the rib 18 is that it is wide enough to prevent rotation of the railroad coupler mount on an axis perpendicular to the mounting face of the coupler head 10.

A handle 30 is provided to rotate the hook 20 between its upright position shown in FIG. 2 and its transverse position and to tighten the hook 20 against the inside upper lip 28. The handle 30 can be directly connected to the hook 20 by a threaded member 32 as shown in FIG. 2 or may be connected by a linkage described below in conjunction with FIGS. 6 through 8. In the transverse position, the hook 20 is more easily inserted into or removed from the coring hole 12*a*. After insertion into the coring hole 12*a*, the hook 20 is first rotated to its upright position and drawn tightly against the inside upper lip 28 using the handle 30.

While FIG. 2 shows the railroad coupler mount secured to the top front coring hole 12*a* of the coupler head 10, it should be understood that the railroad coupler mount could easily be secured to the top rear coring hole 12*b* and that the position of the hook 20, jaw 22 and pad 24 could be changed to allow mounting on the bottom coring holes 14*a* and 14*b*. All that is required to practice the invention is to have a single hook 20 which is insertable into a coring hole and which can be tightened against an inside lip of the coupler head 10, a jaw 22 which firmly engages the rip 18, and a pad 24 or other abutting surface so that the railroad coupler mount has three points of contact with the coupler head 10. End-of-train signaling and monitoring equipment 34 can be positioned above and hose connections 36 for connecting with brake line hoses 38 can be positioned below the railroad coupler mount assembly, and may be integral with or separate from the railroad coupler mount assembly.

Figure 3:
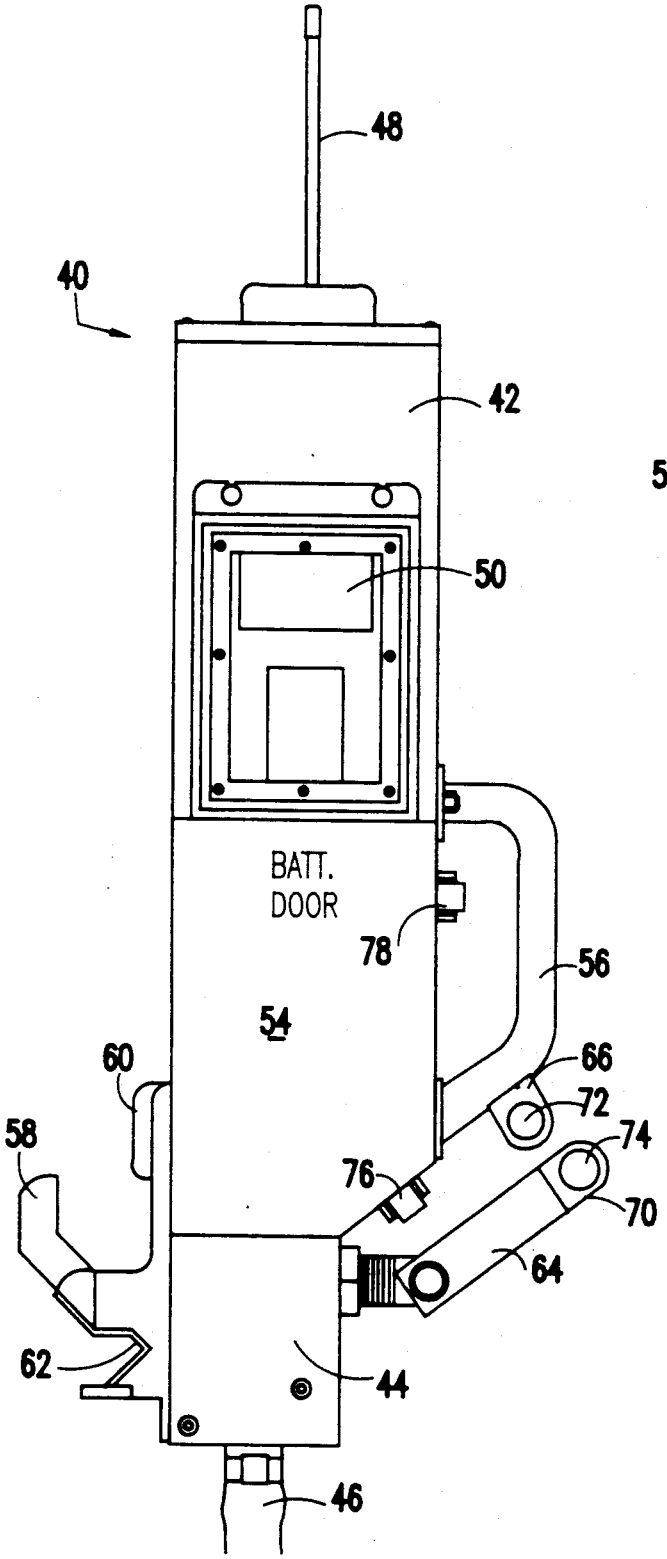
FIGS. 3, 4, and 5 are front, side and top views, respectively, of a preferred end-of-train signalling and monitoring equipment package which includes a railroad coupler mount according to the present invention.
Figure 4:
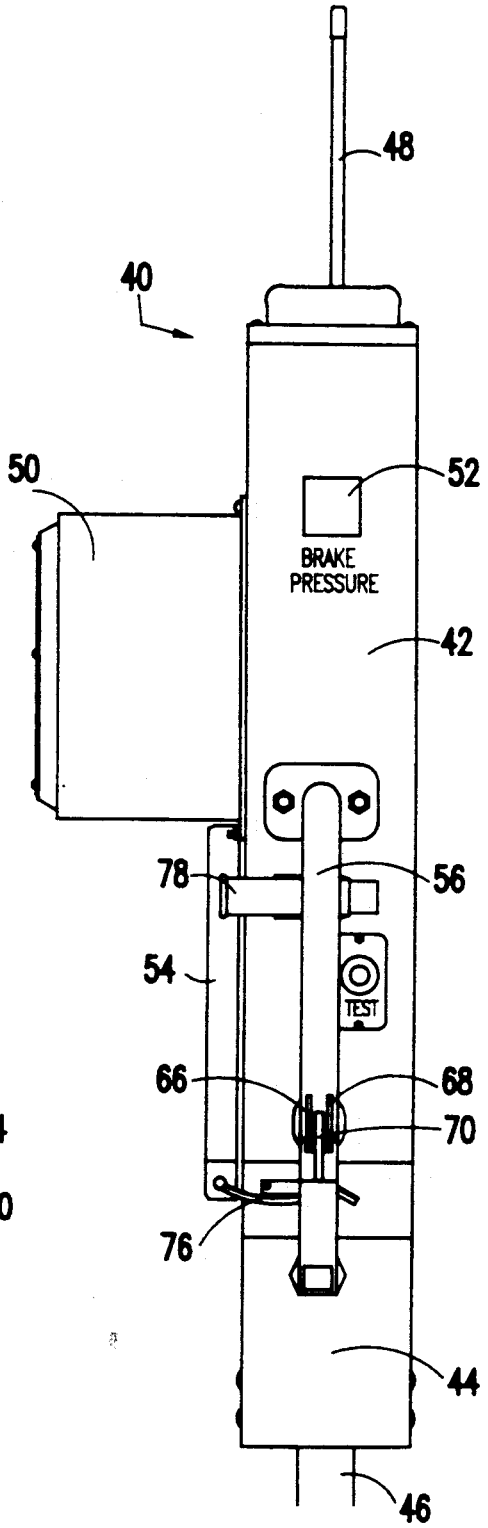
Figure 5:
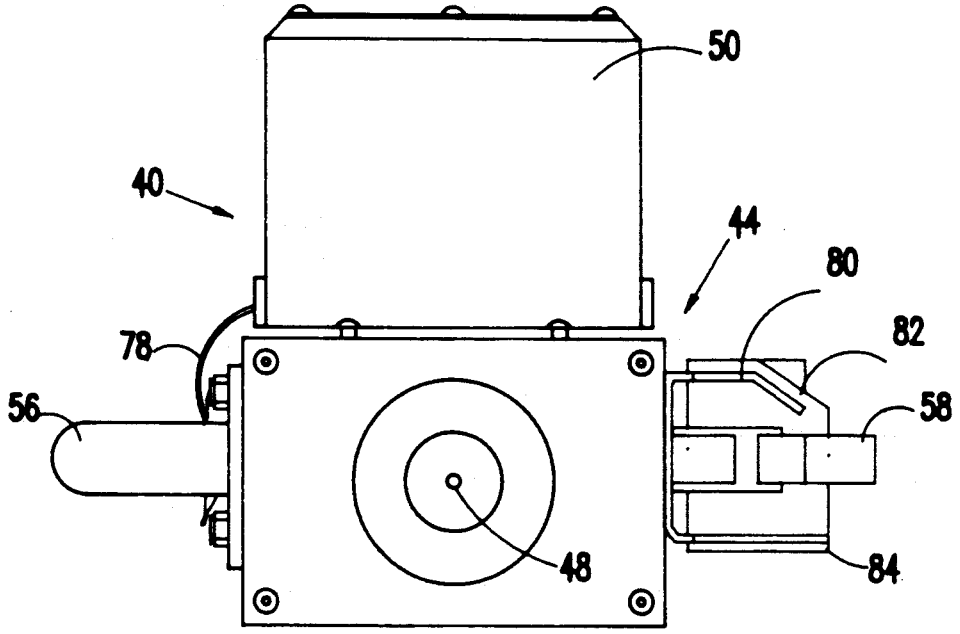

FIGS. 3 through 5 illustrate a preferred end-of-train signalling and monitoring equipment package 40 which includes the signalling and monitoring equipment 42, the railroad coupler mount 44, and hose connections 46. The signalling and monitoring equipment 42, railroad coupler mount 44, and hose connections 46 can be part of one integral package 40 or be separable in a manner which leaves the railroad coupler mount 44 on the coupler head while the signalling and monitoring equipment 42 is transported elsewhere. The signalling and monitoring equipment 42 includes a radio antenna 48 for telemetering train operating information to an engineer in the locomotive cab, an end-of-train marker light 50, display 52 for providing train operating information locally to train personnel at the site of attachment of the equipment 42 to the coupler head, and a battery compartment to which access is permitted by a battery door 54. A carrying handle 56 connected to the signalling and monitoring equipment 42 is provided to allow a single person to transport and install the entire package 40.

The batteries used in end-of-train signalling and monitoring equipment 42 are long-lasting and generally expensive (e.g., nickel-cadmium or the like), and may be stolen in a railroad yard if easy access is allowed while the signalling and monitoring equipment 42 is installed on a coupler head. Therefore, it is advantageous to provide a locking means to secure the battery compartment door 54. Since a lock or other retaining device is needed to secure the hook 58 in its upright, lip engaging position while the coupler mount 44 is in use where the pad 60 bears against the outside surface of the coupler head and the jaw 62 engages the rib between the coring holes (see..discussion of FIG. 2), it has been found advantageous to use the handle 64 to fulfill the dual functions of securing the hook 58 in its upright position and locking the battery compartment door 54; thereby, only requiring one lock for both functions. As is best shown in FIGS. 3 and 4, the carrying handle 56 includes a pair of spaced apart tabs 66 and 68 which accommodate a tab 70 on the end of the handle 64. When the handle 64 has been rotated to its upright position to lock the hook 58 into engagement with the upper lip of the coring hole, the tab 70 is slid between tabs 66 and 68 projecting from the handle 64 and a lock (not shown) is passed through the apertures 72 and 74 in the tabs 66/68 and 70, respectively. When locked into place, the handle 64 is sufficiently close to latch 76 that it cannot be unlatched; thereby, keeping the battery compartment door 54 locked shut. The battery compartment door 54 is designed so that both batches 76 and 78, each of which may be of the drawn latch variety, must be unlatched before it can swing open.

FIG. 5 shows that a portion of the bracket 80 used in the coupler mount 44 has a chamfered end 82 on one side while the other side has an extended end 84. The chamfered end 82 is used to clear core hole obstructions.

Figure 8:
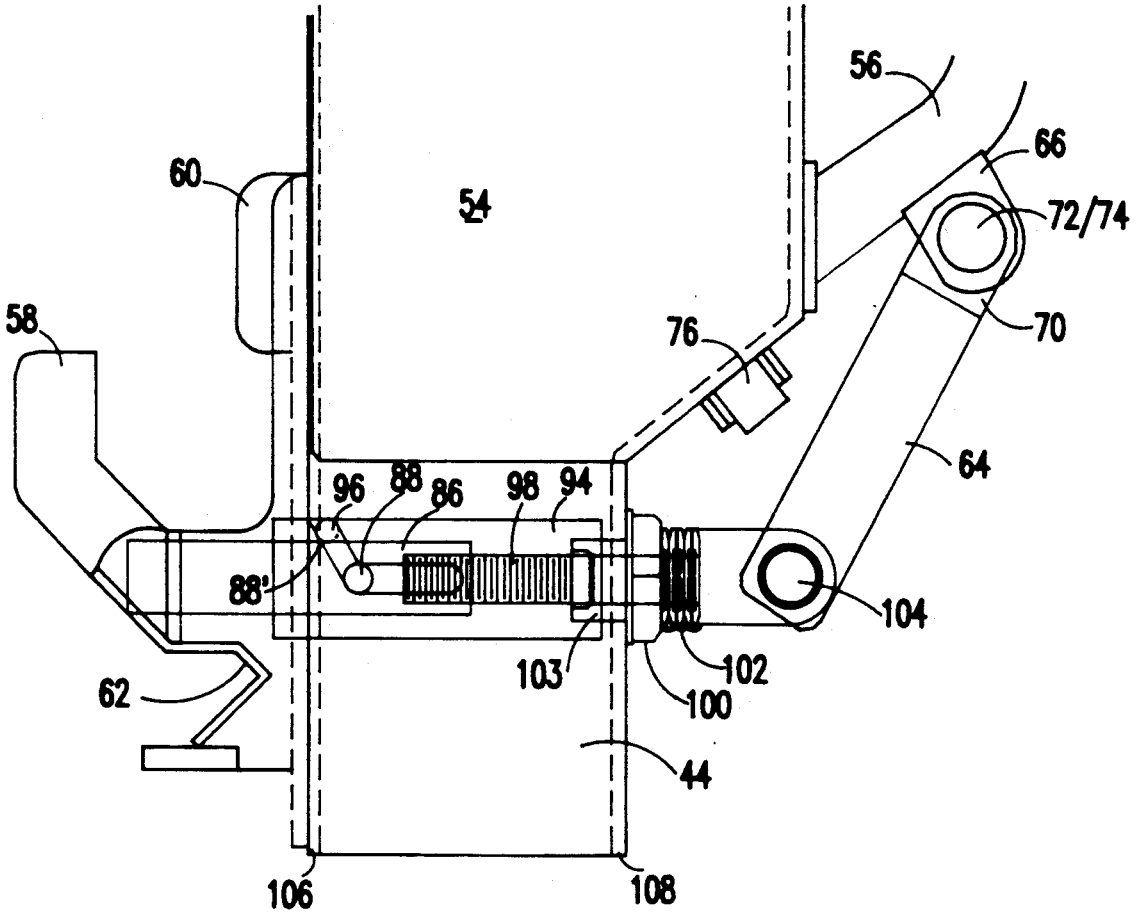
FIG. 8 is a cut-away cross-sectional side view of the bottom portion of the preferred end-of-train signalling and monitoring equipment package illustrating a mechanism for moving the hook member between the transverse and upright positions in the railroad coupler mount.
Figure 6:
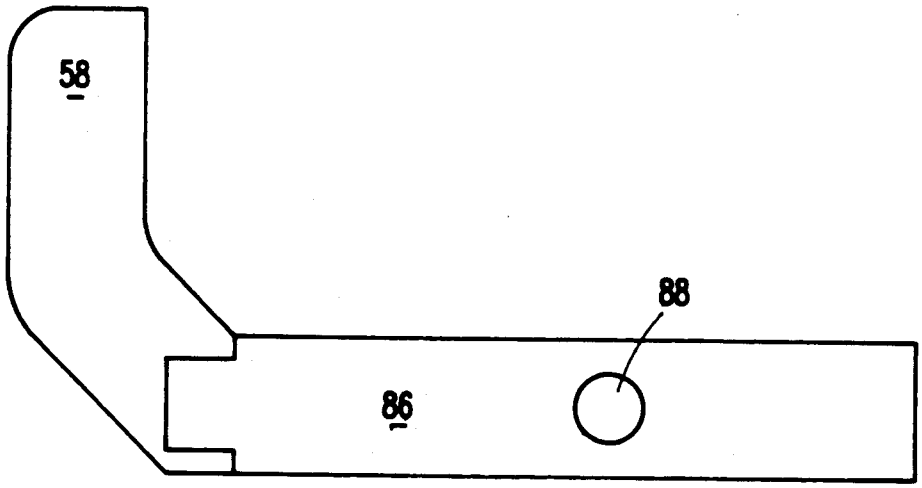
FIG. 6 is an enlarged view of a hook member used in the preferred railroad coupler mount of FIGS. 3 through 5.
Figure 7A:
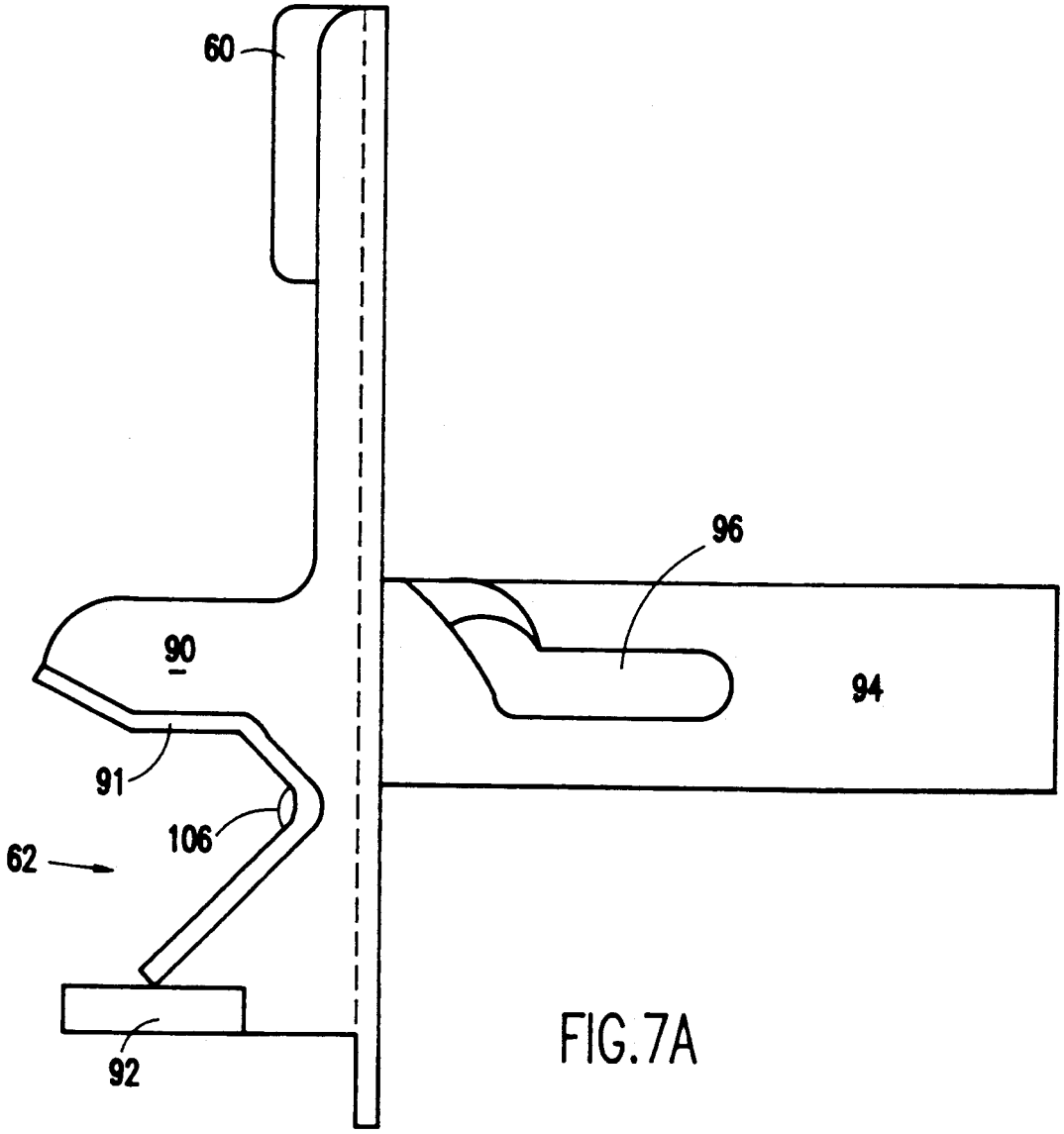
FIGS. 7*a* and 7*b* are enlarged side and front views, respectively, of a mounting bracket member used in the preferred railroad coupler mount of FIGS. 3 through 5.
Figure 7B:
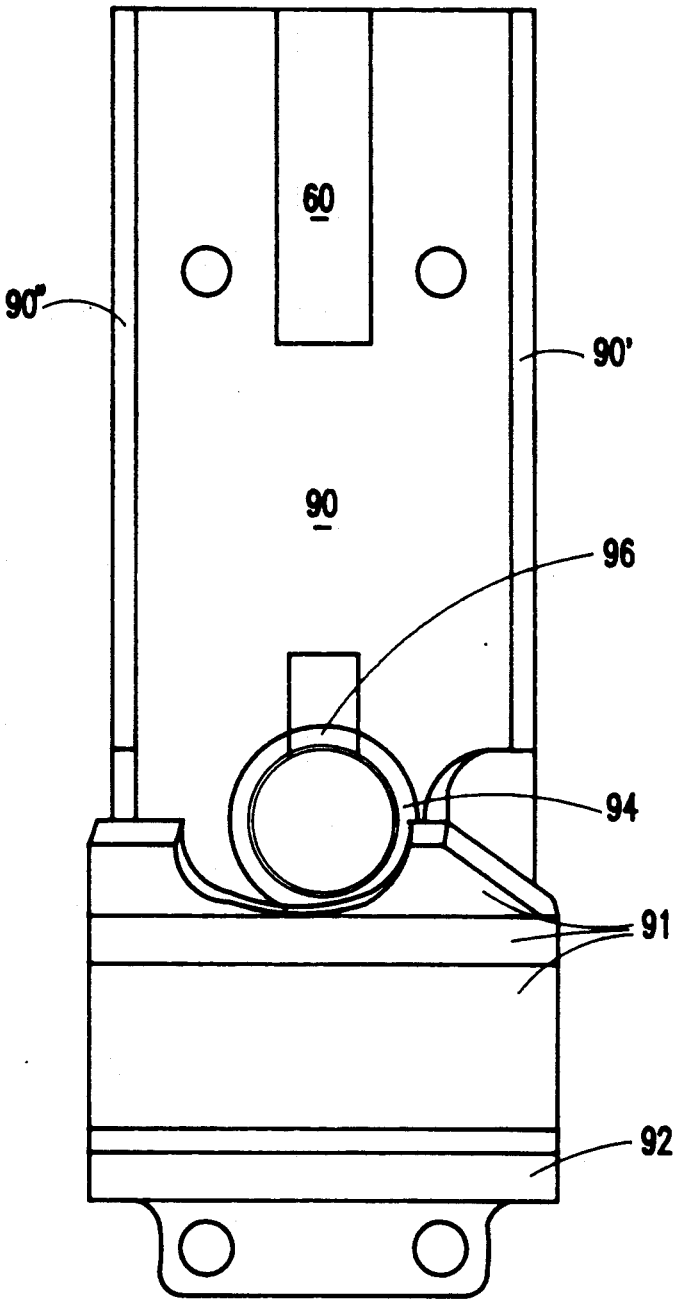

FIGS. 6 through 8 illustrate a preferred linkage between the handle 64 and hook 58. FIG. 6 shows the hook 58 is connected to a tube 86 which has a pin 88 projecting outward from its side. FIG. 7*a* shows a bracket 90 that includes on one side the jaw 62 and the pad 60 which are used to engage the coupler head as described above. The jaw 62 is comprised of two spaced apart shaped side walls of bracket 90, a jaw liner 91 which spans across the of the bracket 90 and fits in the shaped side walls, and a jaw pad 92 which fits underneath the jaw liner 91. The spacing between the shaped sidewalls of the bracket 90 should be wide enough so that the jaw 62 will aid in resisting rotation on an axis perpendicular to the mounting face of the coupler head. FIG. 7*b* illustrates the spacing of the shaped sidewalls 90′ and 90″ of the bracket 90. With reference back to FIG. 7*a*, due to a significant variation in rib width, the jaw 62 has been fashioned with a 90° V-section 106. It has been determined that a 90° V-section 106 is wide enough to accommodate the thickest ribs, yet the 90° base angle is acute enough to tightly grip the top and bottom surfaces of the rib and prevent rotation about an axis perpendicular to the coupler's mating face. The 90° base angle is obtuse enough that even with wide variations in rib thickness, the ribs will still bottom out in the V-section 106 and not cause excessive tilting of the railroad coupler mount on an axis parallel with the rib. To ensure positive retention, the jaw 62 should protrude as deeply as possible into the core holes of the coupler head on either side of the rib while still avoiding obstructions. Therefore, the top portion of the jaw 62 has been designed such that the shaped bracket 90 can extend deeply into the top core hole while the bottom portion of the jaw 62 includes a jaw pad 92 which extends deeply into the lower core hole. The jaw pad 92 also protects the jaw liner 91 from damage. On the other side of the bracket 90, a jack tube 94 with a guide slot 96 has been provided. FIG. 8 shows that the jack tube 94 and guide slot 96 cooperate with the outwardly extending pin 88 on the tube 86 connected to the hook 58.

With particular reference to FIG. 8, the hook 58 is rotated and drawn inward or moved outward relative to the pad 60 by rotating the handle 64. The handle 64 is connected to a screw 98 via a pin 104. The screw 98 passes through the Belleville washer stack 102 and nut 100, and is retained in nut 100 by retaining ring 103. Nut 100 extends into jack tube 94 and provides a firm base for screw 98 to bear against. The screw 98 is connected to threads in the rear opening of tube 86.

As the handle 64 is rotated, the screw 98 causes the tube 86 to be drawn inward or moved outward, thereby moving the hook 58 toward or away from the vicinity of the pad 60. The jack tube 94 bears all the compressive load of the screw 98 so that the enclosure walls 106 and 108 are free of stress. This is accomplished by the screw 98 bearing against the nut 100 and belleville washer stack 102 which, in turn, transmits the screw load to the jack tube 94. The handle 64 does not directly rotate the hook 58; rather, hook rotation is accomplished by the pin 88 of tube 86 riding in the slot 96 of the jack tube 94. As the screw 98 moves the tube 86 inward, the pin 88 slides down the slot 96 in the jack tube 94 and rotates the hook 58 from a transverse position to an upright position in the initial travel of the hook 58. As is indicated by the dashed outline of the pin 88', the enclosure wall 106 prevents the hook 58 and tube 86 assembly from being accidentally ejected from the railroad coupler mount 44 after it has been rotated to its transverse and fully extended position because the pin 88 will abut against the enclosure wall 106 and will prevent the screw 98 from forcing the tube 86 any more forward. It should be understood that the screw 98 is but one of many devices which could be used to move the hook 58 and tube 86 inward and outward, and that other devices including a pneumatic tightener, or the like, could also be used within the practice of the invention.

While the invention has been described in terms of its preferred embodiments, those skilled in the art will recognize that the invention can be practiced with modification within the spirit and scope of the appended claims.

Having thus described my invention, what I claim as new and desire to secure by Letters Patent is as follows:

1. A railroad coupler mount assembly, comprising:

a railroad coupler mount;

a jaw member, connected to said railroad coupler mount, for engaging a rib between a pair of coring holes in a railroad coupler head;

a hook, connected to said railroad coupler mount, for insertion into one of said pair of coring holes, said hook being rotatable between a non-engagement position which allows easy insertion into and removal from said one of said pair of coring holes and an engagement position where said hook is oriented to contact an inside surface of said one of said pair of coring holes;

an abutting member, connected to said railroad coupler mount, for bearing against an inside surface of said railroad coupler head;

means to rotate said hook between said nonengagement and engagement positions; and means for tightening said hook against said inside surface of said one of said pair of coring holes so that said railroad coupler head is firmly held by said hook, said abutting member, and said jaw member.

2. A railroad coupler mount assembly as recited in claim 1 wherein said means for tightening comprises a handle and a screw rotatable by said handle, said screw being connected to said hook so that rotation of said screw translates said hook alternatively toward and away from said jaw member and said abutting member.

3. A railroad coupler mount assembly as recited in claim 2 wherein said screw is connected to said hook by a tubular connecting member and wherein said means to rotate said hook between said non-engagement and engagement positions includes a jack tube encircling said tubular connecting member, said tubular connecting member having a means for cooperating with a slot in said jack tube, said slot in said jack tube being arranged so that said means for cooperating turns said tubular connecting member as said screw is rotated which in turn rotates said hook between said non-engagement and engagement positions.

4. A railroad coupler mount assembly as recited in claim 1 wherein said jaw member has portions which extend to each of said pair of coring holes.

5. A railroad coupler mount assembly as recited in claim 1 wherein said jaw member has a V-shaped base of up to ninety degrees which abuts against said rib.

6. An end-of-train signalling and monitoring equipment package comprising:

a railroad coupler mount assembly which includes (i) a railroad coupler mount;

(ii) a jaw member, connected to said railroad coupler mount, for engaging a rib between a pair of coring holes in a railroad coupler head, (iii) a hook, connected to said railroad coupler mount, for insertion into one of said pair of coring holes, said hook being rotatable between a non-engagement position which allows easy insertion into and removal from said one of said pair of coring holes and an engagement position where a cantilevered portion of said hook is oriented to contact an inside surface of said one of said pair of coring holes, (iv) an abutting member, connected to said railroad coupler mount, for bearing against an outside surface of said railroad coupler head, (v) means to rotate said hook between said non-engagement and engagement positions, and (vi) a handle and a screw for tightening said hook against said inside surface of said one of said pair of coring holes so that said railroad coupler head is firmly held by said hook, said abutting member, and said jaw member, said handle capable of rotating said screw and said screw being connected to said hook so that rotation of said screw translates said hook alternatively toward and away from said jaw member and said abutting member; and battery powered end-of-train signalling and monitoring equipment connected to said railroad coupler mount, said battery powered end-of-train signalling and monitoring equipment including a battery compartment door which is shut closed by latch members, said handle of said railroad coupler mount being lockable in a position which prevents one of said latch members from being unlatched, thereby preventing unauthorized access to a battery in said battery powered end-of-train signalling and monitoring equipment.

* * * * *